United States Patent [19]

Hapka

[11] Patent Number: 4,771,739

[45] Date of Patent: Sep. 20, 1988

[54] COOLING SYSTEM FOR AN INTERNAL COMBUSTION ENGINE

[75] Inventor: Roger J. Hapka, Columbus, Ind.

[73] Assignee: Cummins Engine Company, Inc., Columbus, Ind.

[21] Appl. No.: 54,601

[22] Filed: May 27, 1987

[51] Int. Cl.[4] ..... F01P 7/16

[52] U.S. Cl. ..... 123/41.1; 123/41.09

[58] Field of Search ..... 123/41.1, 41.02, 41.08, 123/41.09

[56] References Cited

U.S. PATENT DOCUMENTS

| | | | |
|---|---|---|---|
| 1,390,724 | 9/1921 | Rumens | 123/41.04 |
| 1,442,966 | 1/1923 | Page et al. | 123/41.02 |
| 2,248,544 | 7/1941 | Maruhn | 123/41.1 |
| 4,393,819 | 7/1983 | Tanaka et al. | 123/41.08 |
| 4,425,878 | 1/1984 | Samuel | 123/41.08 |
| 4,509,481 | 4/1985 | Nagumo | 123/41.02 X |
| 4,616,599 | 10/1986 | Taguchi et al. | 123/41.1 |

*Primary Examiner*—Tony M. Argenbright
*Assistant Examiner*—Eric R. Carlberg
*Attorney, Agent, or Firm*—Neuman, Williams, Anderson & Olson

[57] ABSTRACT

A cooling system having a circulating coolant provided for an internal combustion engine, wherein the coolant temperature substantially remains at a predetermined elevated temperature while the engine is operating at a load below a predetermined amount and within a predetermined ambient temperature range.

2 Claims, 2 Drawing Sheets

COOLING SYSTEM FOR AN INTERNAL COMBUSTION ENGINE

BACKGROUND OF THE INVENTION

Cooling systems in current internal combustion engines are designed to protect engines from exceeding maximum allowable temperatures during engine operation. Such systems normally incorporate controls such as thermostats, shutters, fan clutches and the like, as a manner of controlling minimum engine temperatures and engine operating temperatures in relation to the ambient temperature conditions and power output requirements of the engine. In such prior systems, the coolant normally approaches elevated temperatures only when the engine is operating in high ambient temperatures, and at or near full power. Thus, a direct relationship exists between the coolant temperature and the engine coolant demands. As a result of such a relationship the operating efficiency of the engine is significantly reduced when the engine is operating at a part load or less condition and in a moderate to low ambient temperature range. Since many engines are normally operated under such conditions for prolonged periods of time fuel consumption is inordinately high and coolant dependent accessories such as cab heaters and the like operate less efficiently. In an attempt to overcome these problems, sophisticated and costly controls are employed in some prior cooling systems.

SUMMARY OF THE INVENTION

Thus, it is an object of the invention to provide an improved cooling system which overcomes the aforenoted shortcomings associated with prior systems of this general type.

It is a further object of the invention to provide an improved cooling system which is of simple, practical design and is capable of compensating for a wide variety of engine operating conditions.

It is a still further object to provide a cooling system which improves the operating efficiency of an internal combustion engine and the coolant dependent accessories associated therewith.

Further and additional objects will appear from the description, accompanying drawings, and appended claims.

In accordance with one embodiment of the invention, a cooling system is provided for an internal combustion engine wherein the coolant thereof is substantially maintained at a first predetermined elevated temperature while the engine is operating in a moderate to low ambient temperature range and at part load condition. The system includes a heat exchanger having a coolant inlet and a coolant outlet. Means, responsive to predetermined engine operating conditions, is operatively connected to the heat exchanger for controlling the heat exchange capabilities of the exchanger with respect to the coolant flowing therethrough. Once the engine operation exceeds part load condition, the coolant abruptly assumes a second predetermined temperature which is lower than the first predetermined temperature and then increases therefrom at a predetermined rate as the engine load continues to increase beyond the said part load condition to a full load condition. While the engine is operating at full load, the coolant will maintain the engine operating temperature below a critical level.

DESCRIPTION

For a more complete understanding of the invention, reference should be made to the drawings wherein.

Figure 1:
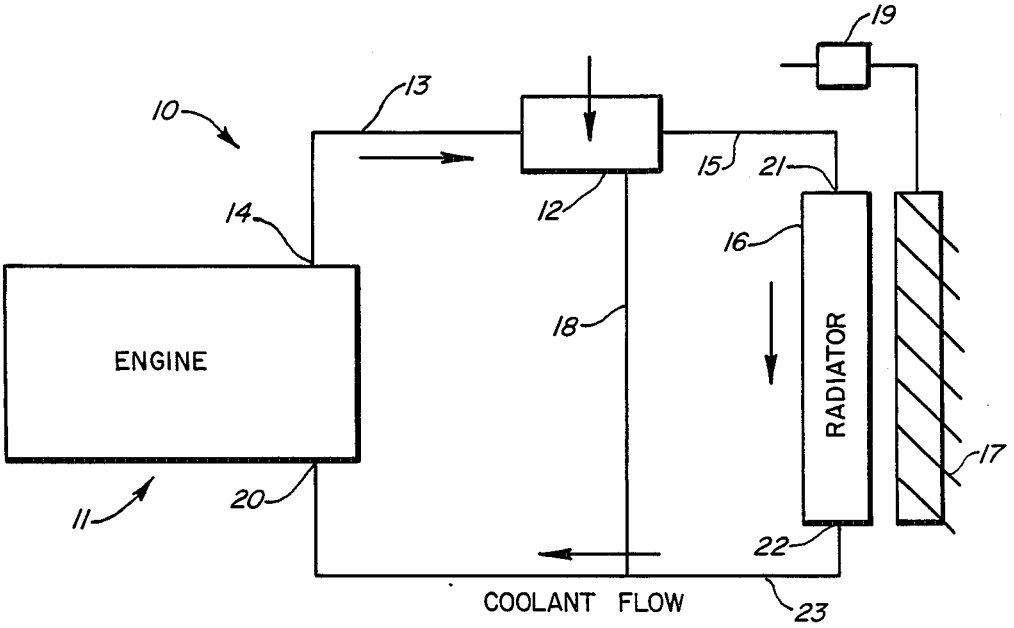
FIG. 1 is a schematic diagram of one embodiment of the improved cooling system for an internal combustion engine.

Referring now to the drawings and more particularly to FIG. 1, one embodiment of the improved cooling system 10 is shown in combination with a conventional water cooled internal combustion engine 11. The type and horsepower rating of the engine may vary over a wide range. System 10, as shown schematically in FIG. 1 includes a thermostat 12 which is connected by pipe section 13 to a coolant outlet port 14 of the engine. From thermostat 12 the coolant flows through either a second pipe section 15 to a heat exchanger 16 which may be a conventional air cooled radiator having an adjustable shutter assembly 17 associated therewith or through a bypass pipe section 18. Pipe section 18 is connected in parallel relation with the heat exchanger. Adjustment of the shutter assembly 17 is regulated by a suitable control 19 which may be responsive to three signal inputs, namely: (a) the temperature of coolant as sensed by thermostat 12; (b) indication of power, which may be measured by a pressure sensitive device, not shown, and (c) ambient temperature. In certain engine cooling systems, the shutter control 19 does not respond to input signals from the thermostat 12, but instead is provided with independent temperature sensors, not shown.

In some installations involving a turbocharged engine, it might be preferred that the power indication and ambient temperature inputs be obtained through a single measurement of the intake air temperature taken at the discharge side of the turbocharger, not shown. Thus, in this latter installation the shutter control is responsive to only two input signals, namely: (a) the temperature of the coolant; and (b) the intake air temperature measured at the turbocharger discharge side.

Figure 3:
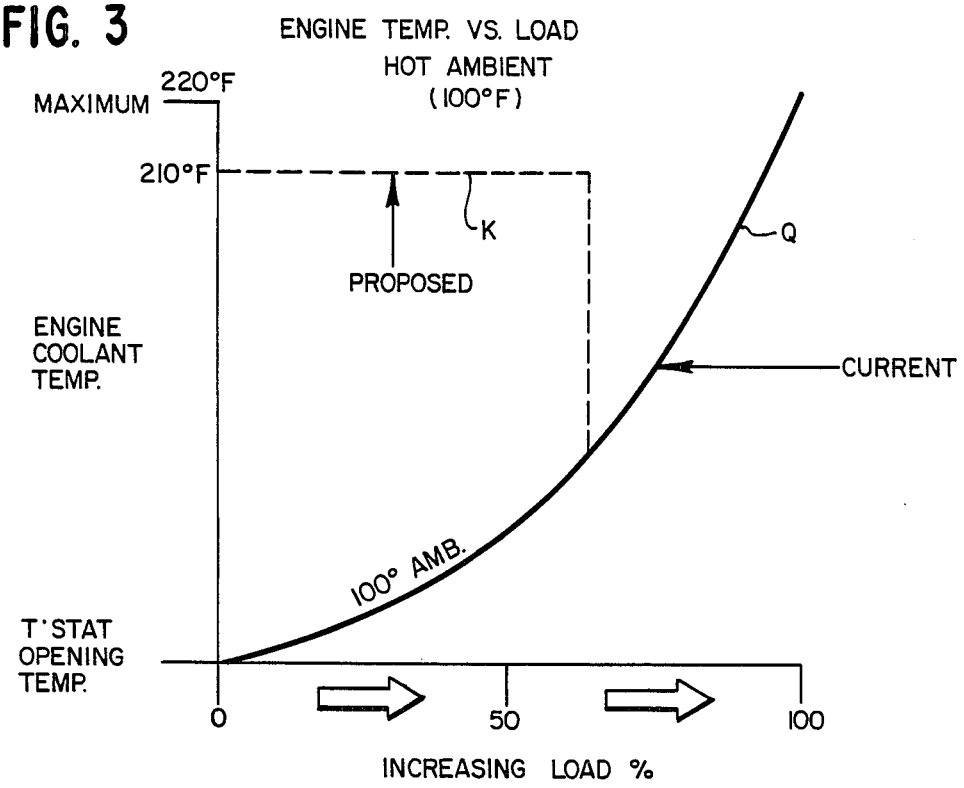
FIG. 3 is a chart or graph wherein the engine load is plotted against the engine coolant temperature while the ambient temperature is at one elevated range.

As will be noted in the chart of FIG. 3, the thermostat 12 or pressure sensing device is preset so that when the engine is operating within an elevated ambient temperature (e.g. 100° F.) and at or below a predetermined load condition of approximately 60%, the engine coolant temperature is maintained at approximately 210° F. which is approximately 10° F. below the critical temperature of approximately 220° F. The coolant is normally a mixture of approximately 50% water and approximately 50% ethylene glycol.

Once the engine load exceeds the predetermined load condition an inverse coolant temperature condition occurs wherein the temperature of the coolant will abruptly or expeditiously drop a substantial amount (e.g. approximately 20°–25° F.). Thereafter as the load condition of the engine continues to increase beyond the predetermined amount, the coolant temperature will rise quickly from the lower temperature until it reaches a temperature wherein the engine operating temperature will not exceed a critical amount. Such rate increase of the coolant temperature is similar to that to be found in conventional cooling systems for internal combustion engines of generally the same size and type and under comparable operating and ambient conditions.

Figure 4:
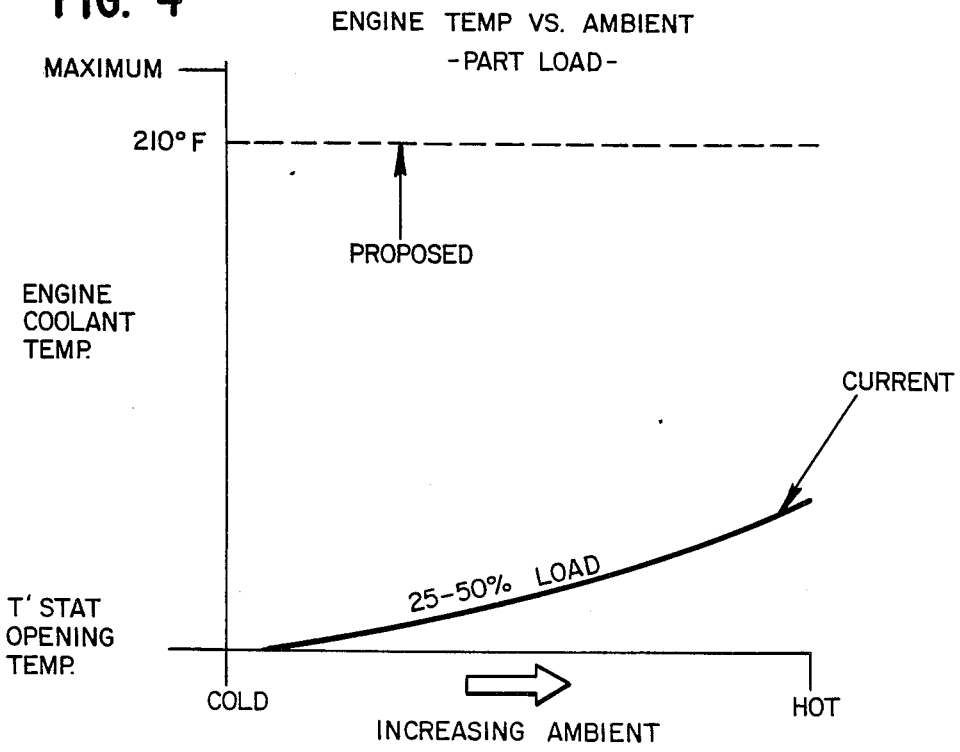
FIG. 4 is a chart or graph wherein the ambient temperature is plotted against the engine coolant temperature while the engine is operating at part load condition.

The chart shown in FIG. 4 plots the engine coolant temperature against increased ambient temperatures while the engine is operating in a part load range of from about 25% to about 50%. The solid line Q in the chart of FIG. 3 represents the operation of a conventional thermostat which would normally occur in prior cooling systems of this general type when the latter are operating in a hot ambient temperature range. That is to say the coolant temperature increases as the load increases. As will be noted, however, the coolant temperature in the improved system under such engine operating conditions remains substantially constant at approximately 210° F., as indicated by dotted line K until the engine load exceeds the predetermined amount. By having the coolant at an elevated temperature, particularly while the engine is operating at a predetermined part load condition, the operating efficiency is significantly improved while at the same time the coolant dependent accessories (e.g. cab heater) are also operated more efficiently.

Figure 2:
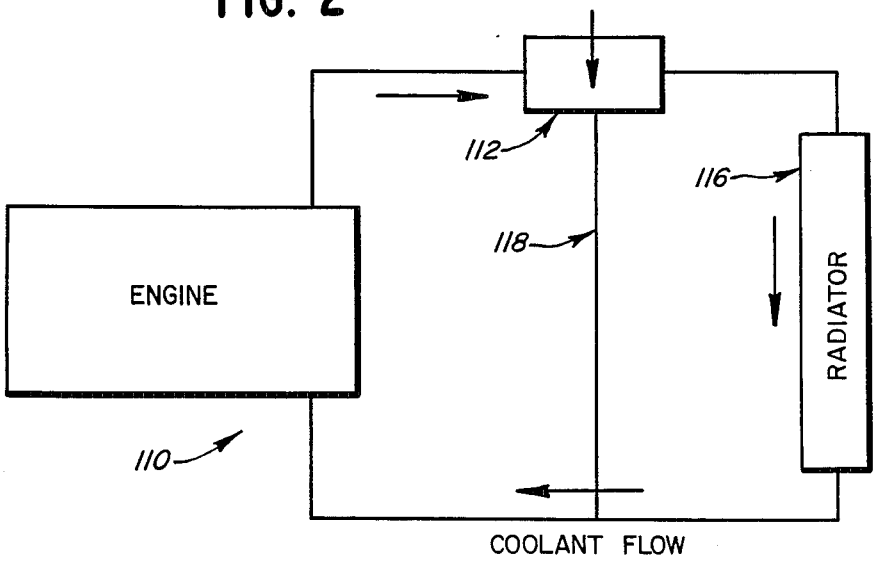
FIG. 2 is similar to FIG. 1 but showing a second embodiment of the improved cooling system.

A second embodiment of the improved cooling system 110 is shown in FIG. 2 which is similar to system 10 except that in system 110 the shutter mechanism and control therefor are replaced by a single electronically controlled valve 112 which controls the rate of coolant flow through the heat exchanger 116 and the by-pass pipe section 118.

Thus, with either embodiment of the improved system, an inverse relationship between the engine cooling requirements and the coolant temperature is established during a certain segment of the cooling system operating range, that is when there is a minimum possibility of exceeding critical engine temperatures.

I claim:

1. In an internal combustion engine having a critical operating temperature which remains substantially constant while the ambient temperature remains substantially constant but below the critical operating temperature, a cooling system comprising means for circulating a coolant at a substantially constant elevated temperature through the engine to maintain the operating temperature of the engine below the critical amount, while the load on the engine does not exceed a predetermined part load condition; a heat exchanger having a coolant inlet and a coolant outlet; and means operatively connected to said heat exchanger and responsive to engine load conditions for controlling the heat exchange capabilities of said heat exchanger with respect to the coolant whereby, when the engine load exceeds the predetermined part load condition, the coolant temperature abruptly drops a substantial amount from said substantially constant elevated temperature and then rises therefrom at a predetermined rate until the engine is operating at full load while not exceeding the critical operating temperature.

2. The cooling system of claim 1 wherein the ambient temperature is substantially 100° F.; the engine critical operating temperature is substantially 220° F.; the predetermined part load condition does not exceed 60% of full load and the substantially constant elevated coolant temperature is substantially 210° F. while the engine does not exceed said predetermined part load condition.

* * * * *